US007938496B1

(12) United States Patent
Cattanach

(10) Patent No.: US 7,938,496 B1
(45) Date of Patent: May 10, 2011

(54) HINGED TURNTABLE

(76) Inventor: Victor H. Cattanach, Gresham, OR (US)

( * ) Notice: Subject to any disclaimer, the term of this patent is extended or adjusted under 35 U.S.C. 154(b) by 7 days.

(21) Appl. No.: 12/631,921

(22) Filed: Dec. 7, 2009

(51) Int. Cl.
*A47B 46/00* (2006.01)

(52) U.S. Cl. ..... 312/305; 312/277

(58) Field of Classification Search ..... 108/139, 108/140, 142, 103, 22; 312/125, 135, 305, 312/277; 248/349.1, 430, 344.21, 344.26, 248/344.1, 349, 346.06, 346.07; 211/144, 211/163, 58, 56, 78, 131.1
See application file for complete search history.

(56) References Cited

U.S. PATENT DOCUMENTS

| | | | | | |
|---|---|---|---|---|---|
| 100,622 | A | * | 3/1870 | Hawley | 312/281 |
| 239,237 | A | * | 3/1881 | Forncrook | 312/322 |
| 809,321 | A | * | 1/1906 | Peters | 108/63 |
| 1,136,120 | A | * | 4/1915 | Goldsmith | 126/338 |
| 2,142,008 | A | * | 12/1938 | Scott | 312/305 |
| 2,542,394 | A | | 2/1951 | Cohen et al. | |
| 2,639,523 | A | | 5/1953 | Beigler | |
| 2,730,416 | A | * | 1/1956 | Williams | 108/77 |
| 2,759,576 | A | | 8/1956 | Townsend | |
| 2,878,089 | A | * | 3/1959 | Mark | 312/29 |
| 2,963,332 | A | * | 12/1960 | Breuning | 312/231 |
| 3,246,613 | A | * | 4/1966 | Johnston et al. | 108/20 |
| 3,465,894 | A | | 9/1969 | Setecka | |
| 3,858,529 | A | | 1/1975 | Salladay | |
| 4,143,669 | A | * | 3/1979 | Minkin | 134/153 |
| 4,169,625 | A | * | 10/1979 | Petersen | 297/344.26 |
| 4,198,718 | A | * | 4/1980 | Ballard | 5/93.2 |
| 4,305,563 | A | * | 12/1981 | Presson | 248/349.1 |
| 4,334,482 | A | | 6/1982 | Bolduc | |
| 4,531,645 | A | | 7/1985 | Tisbo et al. | |
| 4,643,104 | A | | 2/1987 | Rasmussen | |
| 4,708,408 | A | * | 11/1987 | Kennon | 312/9.46 |
| 5,403,079 | A | | 4/1995 | Fetisoff | |
| 5,626,079 | A | * | 5/1997 | Summers | 104/44 |
| 6,032,585 | A | * | 3/2000 | Pinch | 108/36 |
| 6,154,956 | A | * | 12/2000 | Frohardt | 29/825 |
| 6,547,323 | B1 | * | 4/2003 | Aitken et al. | 297/113 |
| 6,676,208 | B2 | * | 1/2004 | Lu | 297/188.2 |
| D493,311 | S | | 7/2004 | Searer | |
| 6,908,000 | B2 | | 6/2005 | Craft et al. | |
| 2003/0107305 | A1 | * | 6/2003 | Kusztal et al. | 312/223.3 |
| 2006/0032416 | A1 | * | 2/2006 | Vonck | 108/139 |
| 2007/0013211 | A1 | * | 1/2007 | Crowell | 297/16.2 |
| 2007/0273257 | A1 | * | 11/2007 | Hui | 312/274 |

* cited by examiner

*Primary Examiner* — Janet M Wilkens
(74) *Attorney, Agent, or Firm* — Montgomery Patent and Design, LLC; Robert C. Montgomery

(57) ABSTRACT

A foldable turntable surface capable of being compactly stored therewithin a cabinet comprising two (2) folding round shelves hingedly connected to a center section is herein disclosed. The hinges divide the turntable surface in such a manner that the shelves may be folded into the center to allow the turntable to be removed through a standard cabinet door opening. This allows the turntable surface to be used in existing kitchen cabinets not equipped with a turntable during original construction.

3 Claims, 4 Drawing Sheets

HINGED TURNTABLE

RELATED APPLICATIONS

The present invention was first described in a notarized Official Record of Invention on Nov. 14, 2008, that is on file at the offices of Montgomery Patent and Design, LLC, the entire disclosures of which are incorporated herein by reference.

FIELD OF THE INVENTION

The present invention relates generally to cabinet-type storage units, and in particular, to an installable rotating accessibility unit for cabinet-type storage unit shelves.

BACKGROUND OF THE INVENTION

Cabinets and other similar small, enclosed storage units are very widespread in use because of their convenience, protective features, aesthetic appeal, and versatility. Such small, shelved units provided with doors can feature various styles such as wall-hanging, floor-mounted, specialty corner units and the like.

One prevailing issue with such storage units which only provide access along one (1) side is that of reaching particular stored items. When cabinets and the like are loaded from the door, the items that are stored in the back can only be accessed by rooting through all of the items in the front. Additionally, some corners and the backs of particularly high shelves may become nearly entirely inaccessible due to the closed nature of the storage. This results in increased time of use and a decrease in the available usable storage space provided by the storage units.

Various attempts have been made to provide storage units with increased and easier access and storage. Examples of these attempts can be seen by reference to several U.S. patents. U.S. Pat. No. 4,531,645, issued in the name of Tisbo et al., describes a portable storage console for storing a plurality of items. The Tisbo apparatus has shelving units which extended fully on rollers to provide a user with full access to the stored items.

U.S. Pat. No. 6,908,000, issued in the name of Craft et al., describes a multi-tiered corner shelving unit. The Craft apparatus provides rotating platforms for each shelving level in order to allow the user rotating access to the contents of the corner shelving unit.

Additionally, ornamental designs for a rotating shelf exist, particularly U.S. Patent Nos. D 493,311. However, none of these designs are similar to the present invention.

While these apparatuses fulfill their respective, particular objectives, each of these references suffer from one (1) or more of the aforementioned disadvantages. Many such apparatuses do not provide increased storage for all styles of shelving and cabinets, including corner units. Also, many such apparatuses do not provide physical stable support for dense or heavy item storage, such as may be desired in a kitchen setting or the like. Furthermore, many such apparatuses are not suitable for cabinets or cannot be installed into existing cabinets and the like. Accordingly, there exists a need for a storage unit with increased storage capacity and ease of access without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means by which to provide for increased storage capacity and easier access for small shelving and storage units such as cabinets. Thus, the object of the present invention is to solve the aforementioned disadvantages and provide for this need.

To achieve the above objectives, it is an object of the present invention to comprise a hinged turntable, which further comprises a platform, a plurality of rollers, an anchor plate attached to the platform, and a turntable attached to the anchor plate.

Another object of the present invention is to comprise the platform of a center shelf portion, first and second side shelf portions, and a pair of hinges which pivotally connect the first and second side shelf portions to opposite sides of the center shelf portion. The first and second side shelf portions are foldable from a coplanar horizontal position to a parallel vertical orientation defined perpendicular to the center shelf portion.

Yet still another object of the present invention is to attach the plurality of rollers to each of the first and second side platforms.

Yet still another object of the present invention is to comprise the hinges of axial piano-type hinges arranged in a parallel manner. The hinges are partially recessed along a top surface of the platform so that items can freely slide across the platform.

Yet still another object of the present invention is to further comprise the hinges of a removable hinge pin which extends through each hinge. The hinge pins have threaded opposed ends for retaining the hinge pin at a stable position.

Yet still another object of the present invention is for the platform to define a circular coplanar surface, which comprises a rim portion formed along a top surface. The rim portion has a plurality of beveled edges along the perimeter placed adjacent to the hinges so that the first and second side shelf portions can pivot relative to the center shelf portion.

Yet still another object of the present invention is to comprise the plurality of rollers of ball bearing rollers which are recessed into a bottom surface of the first and second side shelf portions so as to be coplanar with the turntable at the center shelf portion. The rollers sufficiently distribute the weight of a load of items on the platform.

Yet still another object of the present invention is to comprise the turntable of a means to support and rotate the apparatus when in the flattened state. The turntable is affixed to and in rotating mechanical communication with the anchor plate portion.

Yet still another object of the present invention is to comprise the anchor plate of an attachment means to allow connection to the center shelf portion of the platform. The attachment means comprises a plurality of common fasteners such as screws, rivets, or the like.

Yet still another object of the present invention is for the turntable and anchor plate assembly to allow a user to easily rotate the apparatus in either a clockwise or counterclockwise direction while applying a minimal side force. In a preferred embodiment, the turntable and anchor plate comprise a commercially available rotating unit utilizing a plurality of ball bearings operating within a circular track system.

Yet still another object of the present invention is to provide a method of utilizing the apparatus that provides a unique means of installing the invention into an existing cabinet or similar storage unit with limited accessibility, and a unique means of easily and quickly accessing materials that are subsequently stored on the apparatus.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
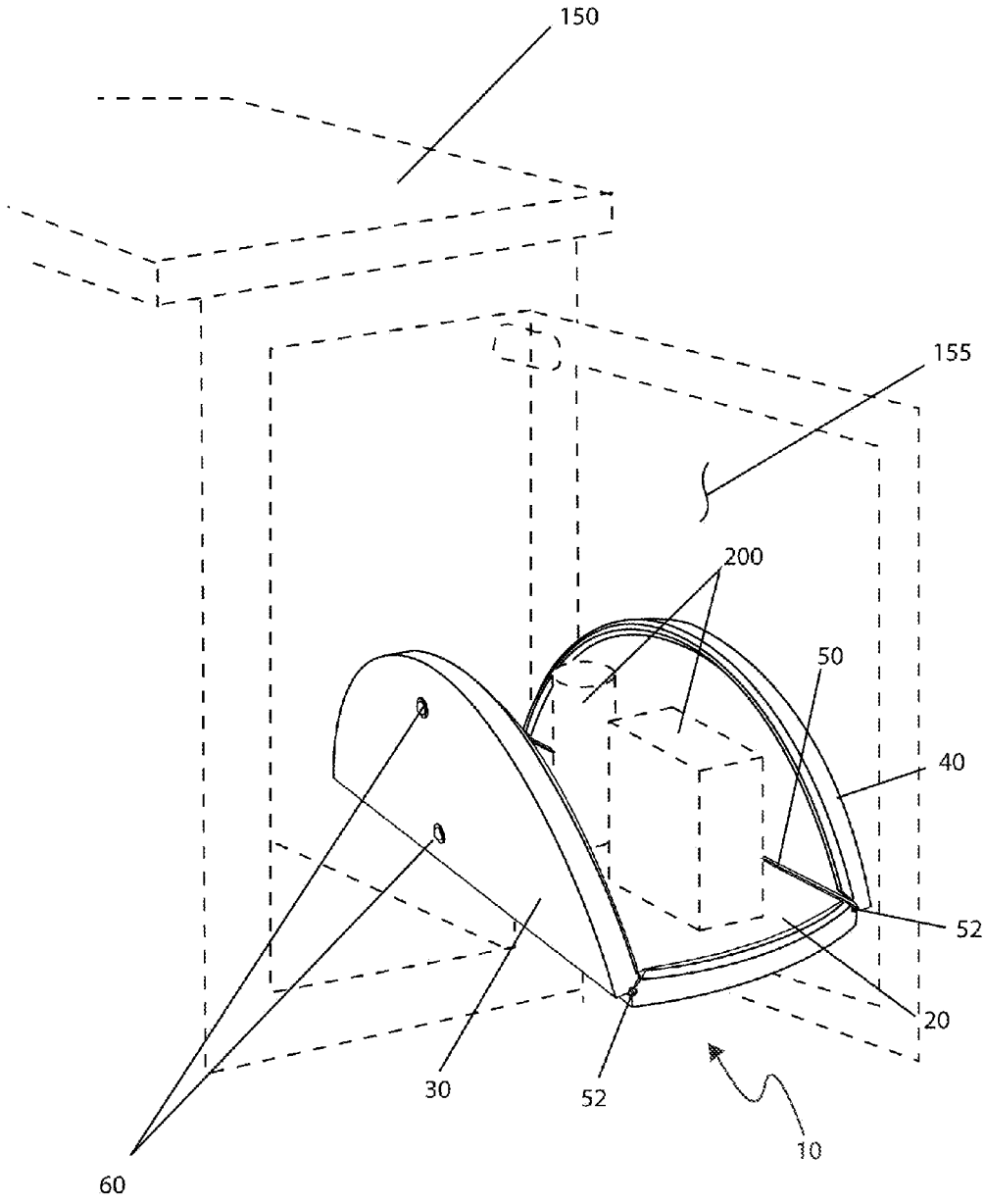
FIG. 1 is an environmental view of a hinged turntable for cabinets 10, according to a preferred embodiment of the present invention.

| | |
|---|---|
| 10 | hinged turntable for cabinets |
| 20 | center shelf portion |
| 30 | first side shelf portion |
| 40 | second side shelf portion |
| 50 | hinge |
| 52 | hinge pin |
| 60 | roller |
| 70 | rim |
| 72 | beveled feature |
| 74 | outer perimeter edge |
| 80 | turntable |
| 82 | turntable anchor plate |
| 100 | fastener |
| 150 | cabinet |
| 155 | cabinet door |
| 200 | item |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a hinged turntable for cabinets (herein described as the "apparatus") 10, providing a storage means for various items 200 thereupon within a cabinet 150. The apparatus 10 comprises a round three-section platform having two (2) semi-circular side shelf portions each affixed thereto a center section 20 using piano-style hinges 50. The apparatus 10 provides a storage means thereto a variety of common items 200 such as, but not limited to: kitchen supplies, food stuffs, health and beauty products, eating utensils, and the like. The hinges 50 divide the apparatus 10 in such a manner that the side shelf portions 30, 40 may be folded upwardly thereto a vertical orientation to allow the apparatus 10 to be inserted or removed therethrough a standard cabinet door opening 155, thereby allowing the apparatus 10 to be used in an existing kitchen cabinet 150 which was not equipped with a turntable device during original construction.

Referring now to FIG. 1, an environmental view of the apparatus 10, according to the preferred embodiment of the present invention, is disclosed. The apparatus 10 comprises a center shelf portion 20, a first side shelf portion 30, a second shelf portion 40, and a pair of hinges 50. The apparatus 10 comprises a round platform approximately thirty (30) inches in diameter which when in a folded state is approximately ten (10) inches wide. The circular shape of the apparatus 10 is divided into three (3) sections, each having an approximate equal width and being affixed therewith two (2) axial piano-type hinges 50 arranged in a parallel manner. The apparatus 10 is preferably made using injection-molded sections having integral hinging features; however, it is understood that other materials may be utilized with equal benefit such as wood, metal, or the like and as such should not be interpreted as a limiting factor of the present invention. The hinges 50 allow the side shelf portions 30, 40 to pivot therefrom a coplanar horizontal position thereto a parallel vertical position being perpendicular with respect to the center section 20, thereby allowing the apparatus 10 to compactly slide thereinto a conventional cabinet 150 as seen here (see FIG. 2).

Figure 2:
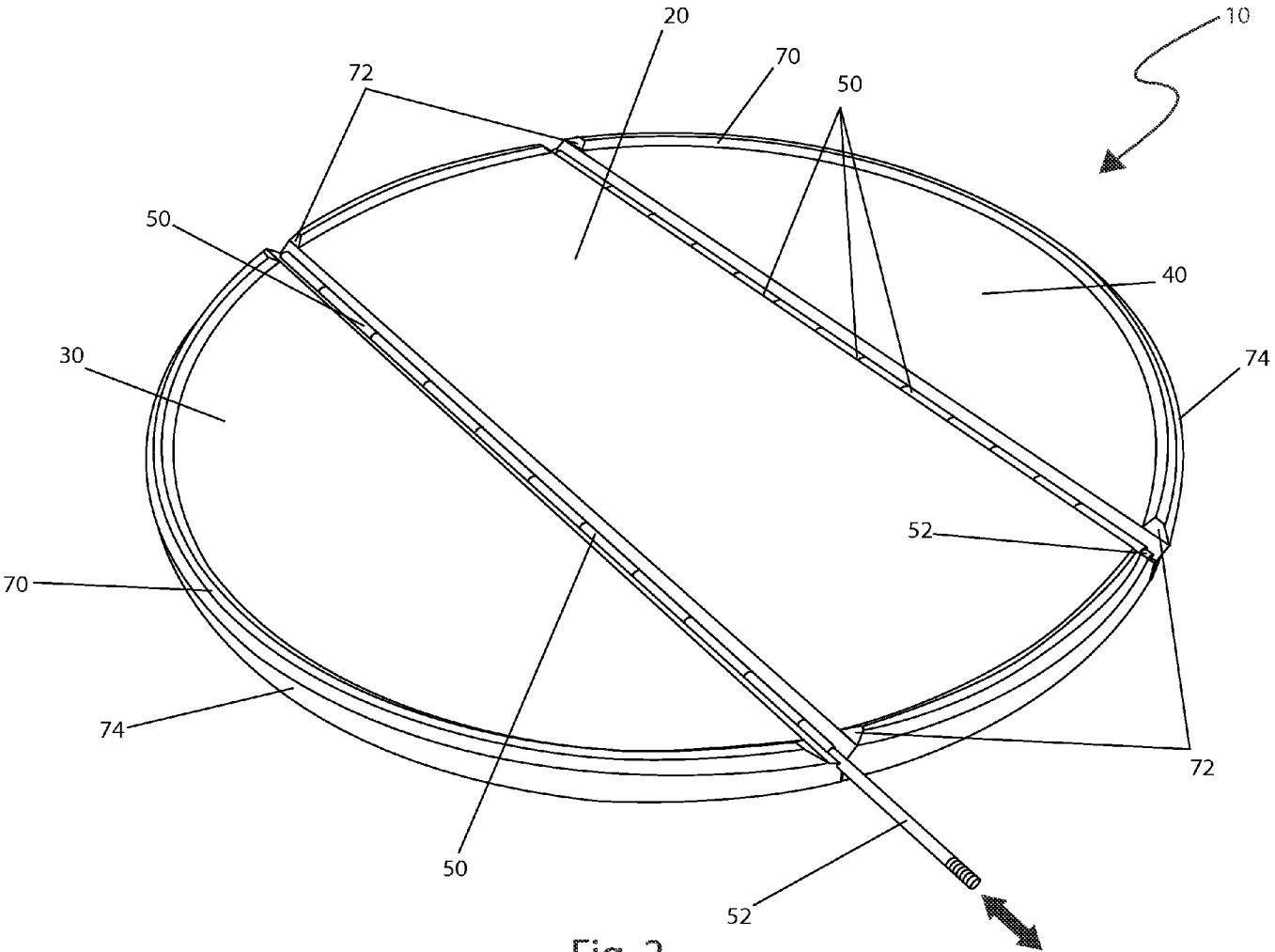
FIG. 2 is a perspective view of the hinged turntable for cabinets 10 depicting a flattened state, according to a preferred embodiment of the present invention.
Figure 3:
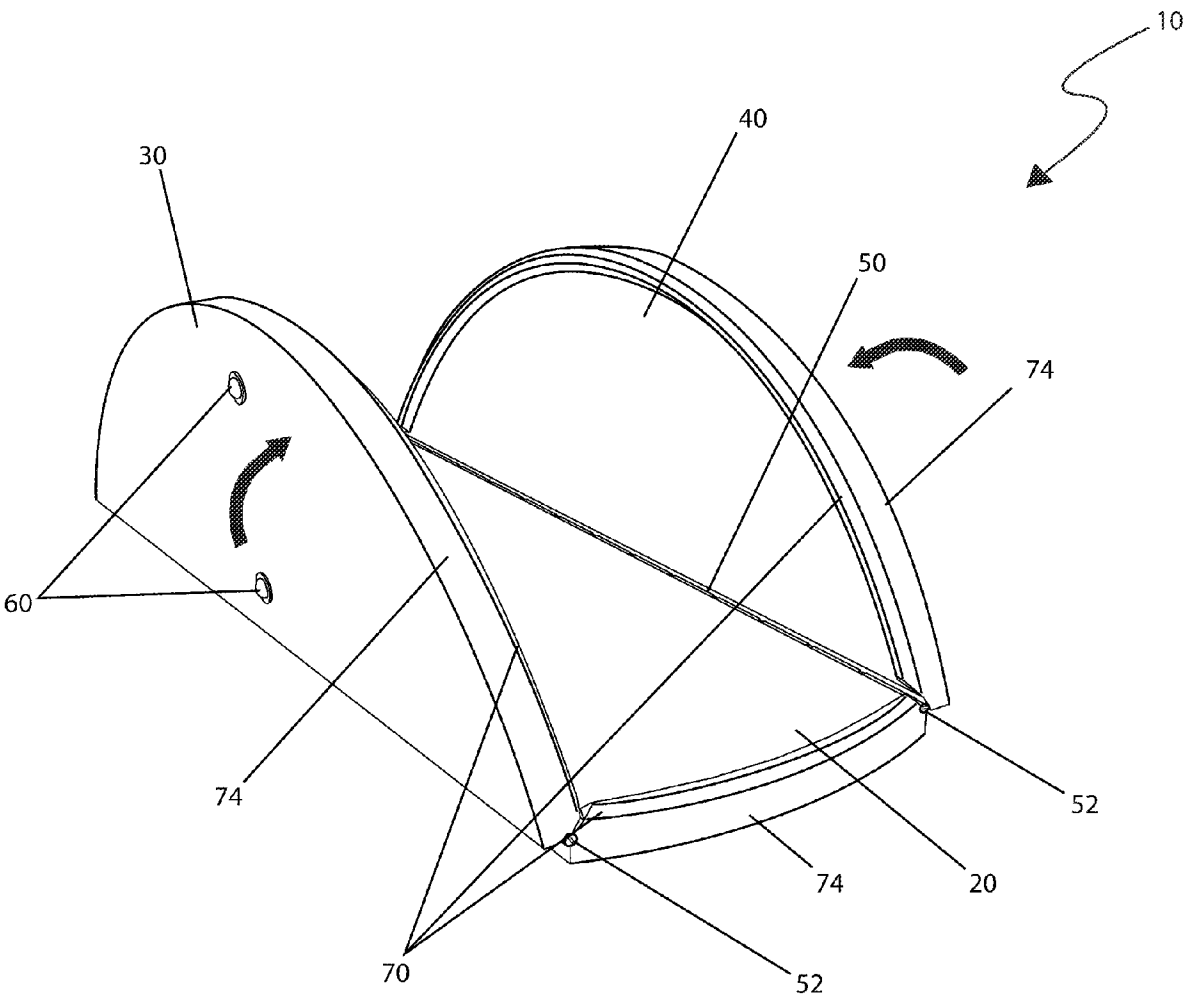
FIG. 3 is a perspective view of the hinged turntable for cabinets 10 depicting a folded state, according to a preferred embodiment of the present invention; and, FIG. 4 is a bottom perspective view of the hinged turntable for cabinets 10, according to a preferred embodiment of the present invention.

Referring now to FIGS. 2 and 3, perspective views of the apparatus 10 depicting flattened and folded states, according to the preferred embodiment of the present invention, are disclosed. The apparatus 10 further comprises a rim portion 70, an outer perimeter edge 74, and a plurality of beveled features 72. The apparatus 10, when folded downwardly, defines a circular coplanar surface on which various kitchen, bathroom, or other items 200 may be placed. The outer perimeter edge 74 of the apparatus 10 comprises a vertical surface having an integral rim portion 70 along a top surface which provides a containment means thereto loose items, spills, sliding items, and the like. Said rim 70 comprises a semi-circular shaped protrusion approximately one (1) inch wide extending therearound said outer perimeter edge 74. Said rim 70 further comprises pairs of beveled features 72 being positioned on each side of a joint formed therebetween adjacent shelf portions 20, 30, 40 of the apparatus 10, thereby providing mechanical clearance during a folded state as well as a mechanical stopping means therebetween said shelf portions 20, 30, 40 when said apparatus 10 is in said folded state as seen in FIG. 3.

The hinges 50 allow the side shelf portions 30, 40 to pivot relative thereto the center section 20. The hinges 50 comprise a slightly recessed construction along a top surface of the apparatus 10, thereby providing an uninterrupted top surface on which various items 200 may slide across freely. The hinges 50 are also envisioned to comprise a slight resistance to rotation, thereby enabling the shelf portions 30, 40 to be retained thereat a vertical orientation if desired, enabling compact storage or transportation thereof. It is further understood that due to the portable nature of the apparatus 10, it may be used in a variety of other locations such as thereupon a counter, table, or the like, or may be easily installed therewithin another cabinet 150 as desired. To further enable compact storage of the apparatus 10, each hinge 50 comprises a centrally located removable hinge pin 52 extending therethrough and retained using a threaded attachment thereat an end portion thereof. Removal of one (1) or both hinge pins 52 allows the apparatus 10 to be disassembled thereinto two (2) or three (3) separate portions, thereby providing convenient stacking thereof, if desired.

Figure 4:
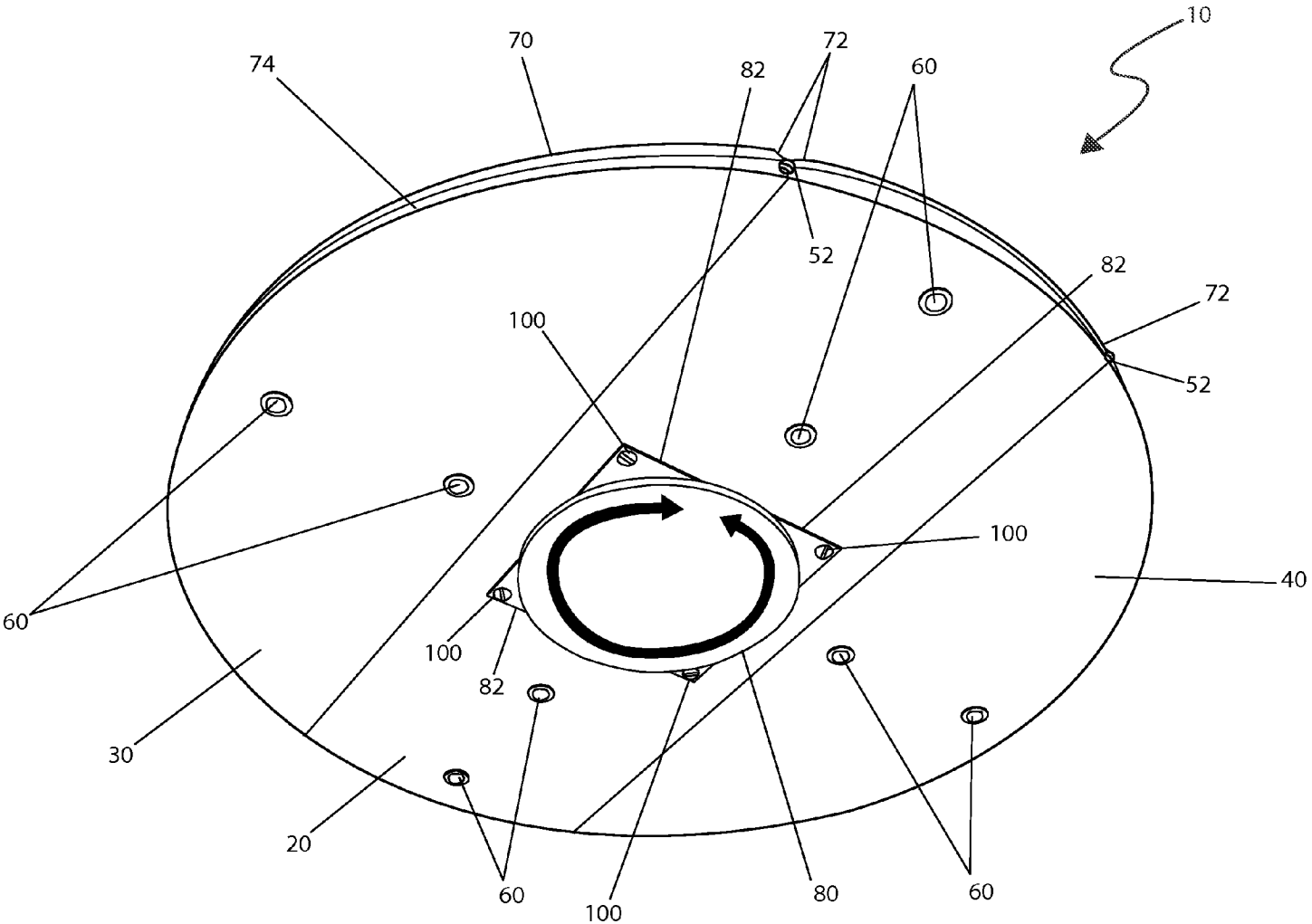

Referring now to FIG. 4, a bottom perspective view of the hinged turntable for cabinets 10, according to a preferred embodiment of the present invention, is disclosed. The apparatus 10 comprises eight (8) rollers 60, a rotating turntable 80, and a turntable anchor plate 82. The rollers 60 and the turntable 80 provide a means to support and rotate the apparatus 10 when in the flattened state. Said rollers 60 and the turntable 80 are to be capable of supporting a load applied thereby the aforementioned items 200 thereupon. Each shelf portion 20, 30, 40 is illustrated here providing attachment thereof a pair of rollers 60; however, any number of roller units 60 may be provided along a bottom surface of said shelf portions 20, 30, 40 based upon the diameter of the apparatus 10, an anticipated loading of said apparatus 10, and available bottom surface area, and as such should not be interpreted as a limiting factor of the apparatus 10. The rollers 60 preferably comprise commercially available single rotating ball bearing units; however, it is understood that various purchased and/or custom designed load-bearing devices incorporating various attachment means such as flanges or fastening ears being affixed using common fasteners 100 may be provided and integrated which allow the apparatus 10 to rotate in a smooth circular manner and as such should not be considered a limiting factor of the apparatus 10. Each ball bearing roller 60 is envisioned to be recessed thereinto a bottom surface of the side portions 20, 30, 40 thereto a sufficient depth so as to be coplanar therewith the turntable portion 80 of the center shelf portion 20, thereby enabling sufficient distribution of a load therefrom loaded items 200 when resting thereupon a flat surface therewithin the cabinet 150.

The center shelf portion 20 provides an attachment means thereto a turntable anchor plate portion 82 of the supporting turntable 80 along a bottom surface using a plurality of common fasteners 100 such as screws, rivets, or the like. The turntable anchor plate portion 82 is affixed thereto and in rotating mechanical communication therewith the turntable portion 80. Said turntable 80 and turntable anchor plate portion 82 preferably comprise a commercially available rotating unit utilizing a plurality of ball bearings operating therewithin a circular track system being designed to rest thereupon a flat surface; however, other low-friction and load-bearing devices may be provided such as a pair of lubricated horizontal sliding plates or discs, or equivalent devices being common in the industry and as such should not be considered a limiting factor of the apparatus 10. The load-bearing and rolling characteristics of the rollers 60 and turntable 80 allow a user to easily rotate the apparatus 10 in either a clockwise or counter-clockwise direction along with the stored items 200 resting along top surfaces thereof, while applying a minimal side force.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: folding the side shelf portions 30, 40 of the apparatus 10 upwardly thereto a vertical orientation or until reaching a mechanical limit defined thereby the beveled features 72 therealong the rim 70; opening a cabinet door 155 and horizontally inserting the apparatus 10 thereinto the cabinet 150; returning one (1) or both side shelf portions 30, 40 thereto a flat horizontal position forming a flat platform in conjunction therewith the center shelf portion 20, based upon available space therewithin said cabinet 150; loading various items 200 such as kitchen supplies, food stuffs, health and beauty products, eating utensils, and the like, thereupon a top surface of the apparatus 10; rotating the apparatus 10 thereabout the turntable 80 while being supported by the ball-bearing rollers 60 in either a clockwise or counter-clockwise direction, as needed to locate a desired item 200 or items; removing and adding any number of items 200 located thereupon the apparatus 10 as needed over a period of time; removing the apparatus 10 therefrom the cabinet 150 by partially or completely unloading the previously stored items 200 therefrom; folding the side shelf portions 30, 40 thereto a vertical orientation; sliding the apparatus 10 out of the cabinet door 155; using the apparatus 10 in a variety of locations such as upon a counter, table, or the like, or installing the apparatus 10 thereinto another cabinet 150 as needed; and, benefiting therefrom convenient portable and rotary-style storage of items 200 using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A method of utilizing a hinged turntable with cabinets, said method comprising the steps of:

providing a round platform further comprising:

a center shelf portion;

first and second side shelf portions;

a pair of axial piano-type hinges arranged in a parallel manner, said pair of hinges are partially recessed along a top surface thereof;

a removable hinge pin extending through each of said pair of hinges, said hinge pin having a threaded end for retaining said hinge pin at a substantially stable position;

a rim portion formed along said top surface thereof, said rim portion having a plurality of beveled edges spaced along a perimeter of said platform and positioned adjacent to said hinges respectively such that said first and second side shelf portions pivot relative to said center shelf portion;

a plurality of ball bearing rollers attached to each of said first and second shelf portions, such that each of said ball bearing rollers is recessed so as to be coplanar with a turntable at said center shelf portion;

pivotally connecting said first and second side shelf portions to opposite sides of said center shelf portion via said hinges such that said platform is divided into three sections;

providing and statically attaching an anchor plate to said platform;

providing and rotatably attaching a turntable to said anchor plate;

upwardly folding said first and second side shelf portions from a coplanar horizontal position to a parallel vertical orientation defined perpendicular to said center shelf portion;

inserting said turntable in said parallel vertical orientation in a space having a narrow opening.

2. The method of claim 1, further comprising the steps of:

inserting said hinged turntable in a cabinet;

storing an amount of desired items on said hinged turntable; and, rotating said hinged turntable upon said plurality of rollers to achieve full access to all of said amount of desired items.

3. The method of claim 1, further comprising the steps of:

downwardly folding said first and second side shelf portions from said parallel vertical orientation to said coplanar horizontal position, if an interior of said space permits said hinged turntable to be stored in said coplanar horizontal position;

storing an amount of desired items on said hinged turntable; and, rotating said hinged turntable upon said plurality of rollers to achieve full access to all of said amount of desired items.

* * * * *